United States Patent [19]

Poulsen

[11] Patent Number: 5,070,457

[45] Date of Patent: Dec. 3, 1991

[54] METHODS FOR DESIGN AND ANALYSIS OF SUBTERRANEAN FRACTURES USING NET PRESSURES

[75] Inventor: Don K. Poulsen, Duncan, Okla.

[73] Assignee: Halliburton Company, Duncan, Okla.

[21] Appl. No.: 535,799

[22] Filed: Jun. 8, 1990

[51] Int. Cl.[5] ..... G01V 1/00; E21B 47/00

[52] U.S. Cl. ..... 364/420; 364/421; 166/250

[58] Field of Search ..... 364/421, 420; 367/35; 166/250, 308, 254; 73/155

[56] References Cited

U.S. PATENT DOCUMENTS

| | | | |
|---|---|---|---|
| 4,109,717 | 8/1978 | Cooke, Jr. | 166/250 |
| 4,398,416 | 8/1983 | Nolte | 73/155 |
| 4,453,595 | 6/1984 | Lagus et al. | 166/308 |
| 4,529,036 | 7/1985 | Daneshy et al. | 116/254 |
| 4,783,769 | 11/1988 | Holzhausen | 367/35 |
| 4,848,461 | 7/1989 | Lee | 166/250 |
| 4,858,130 | 8/1989 | Widrow | 364/421 |

*Primary Examiner*—Dale M. Shaw
*Assistant Examiner*—Xuong M. Chung
*Attorney, Agent, or Firm*—Arnold, White & Durkee

[57] ABSTRACT

A method for determining the geometry of a fracture in a subterranean formation is provided in which the geometry is determined using net fracturing pressure. The method can be used for both fracture design and on-site or post treatment fracture analysis. The method in accordance with the present invention takes into account net pressures throughout the fracturing treatment and compensates for friction pressure in the fracture.

3 Claims, 12 Drawing Sheets

*Net pressure profile: monitoring/analysis example.*

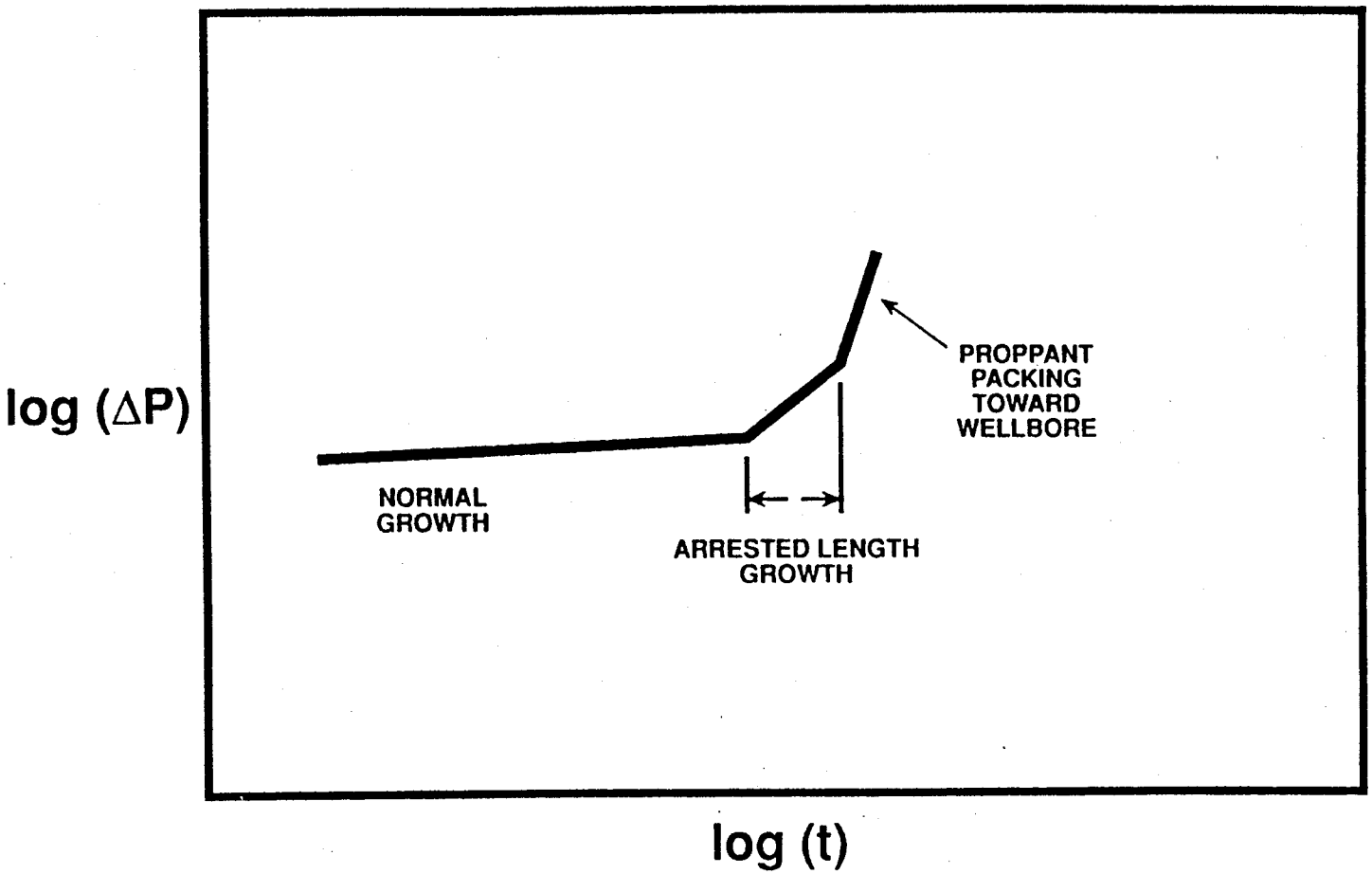
Fig. 1- Net pressure behaviors for normal growth, arrested growth, and proppant packing.

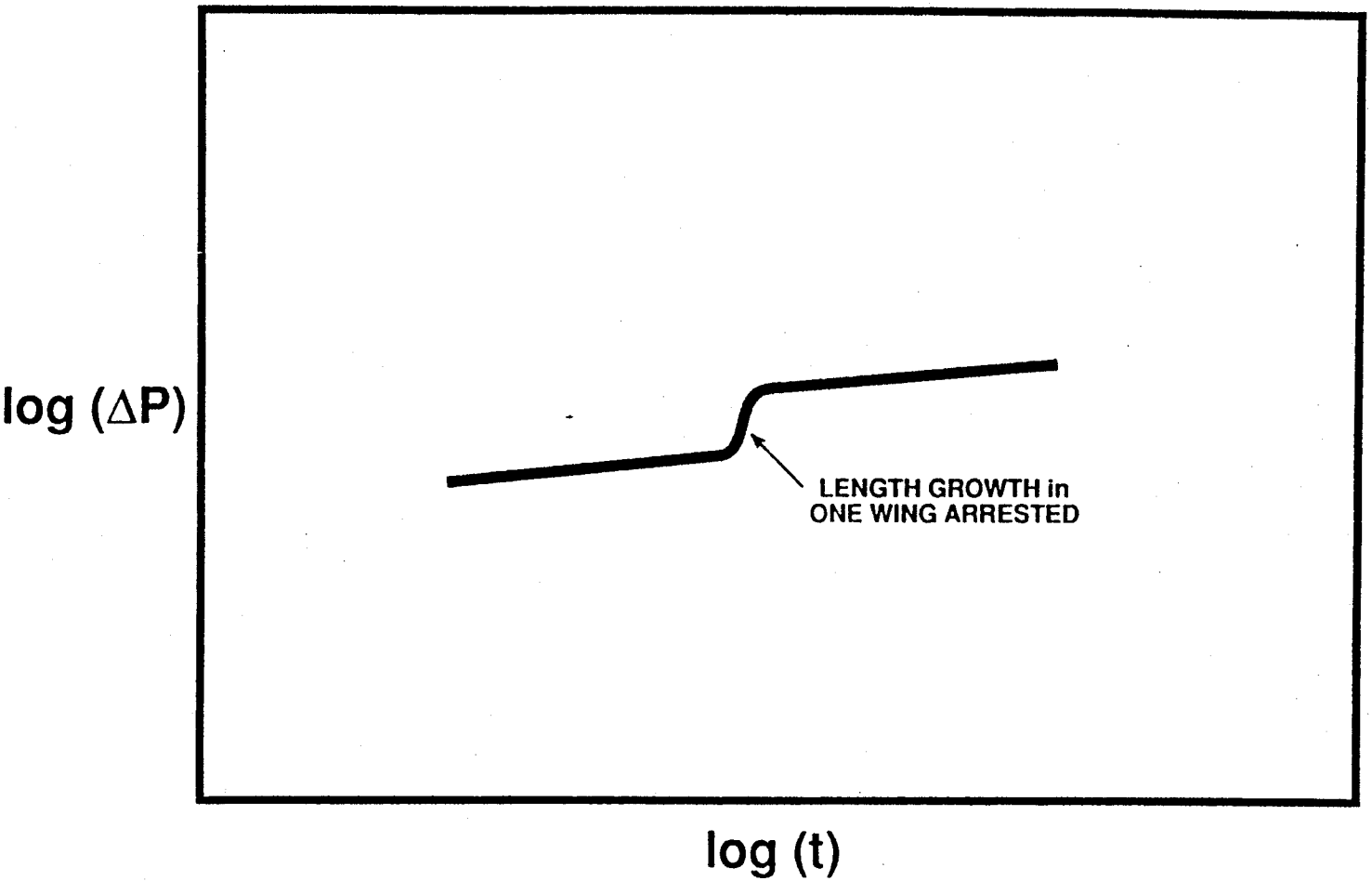
Fig. 2- Net pressure behavior for arrested growth in one wing.

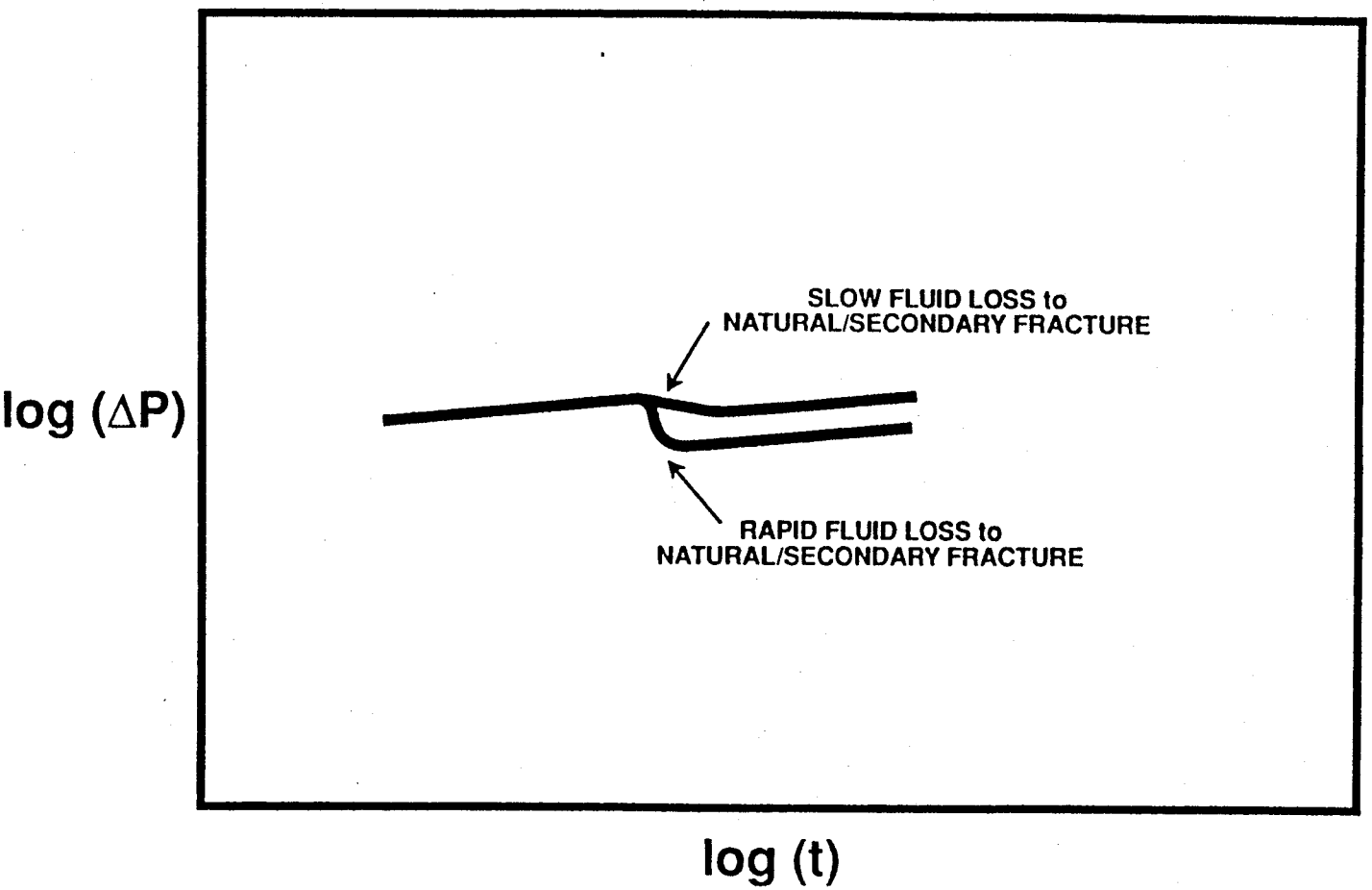
Fig. 3- Net pressure behavior in the presence of natural or secondary fractures.

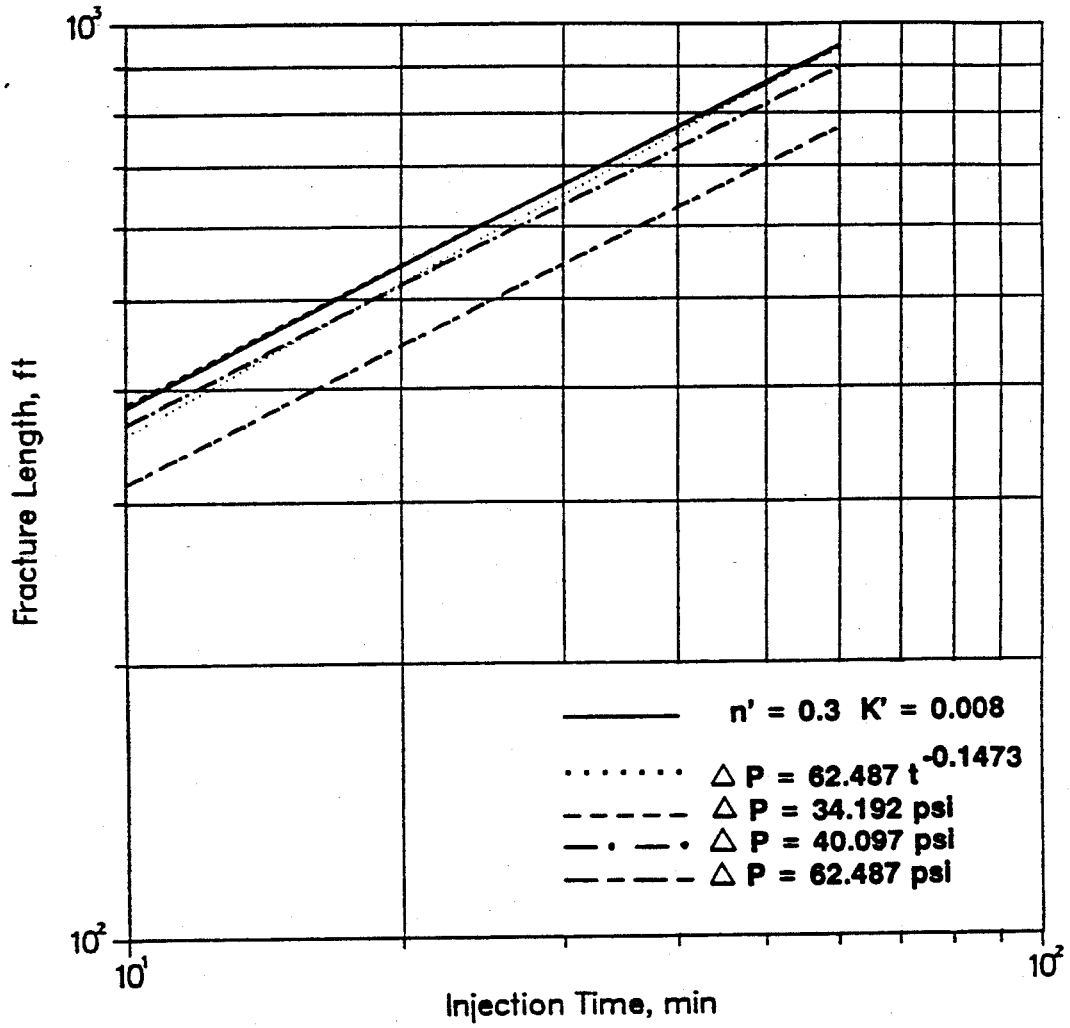
*Fig. 4—Length growth comparison: KZ geometry.*

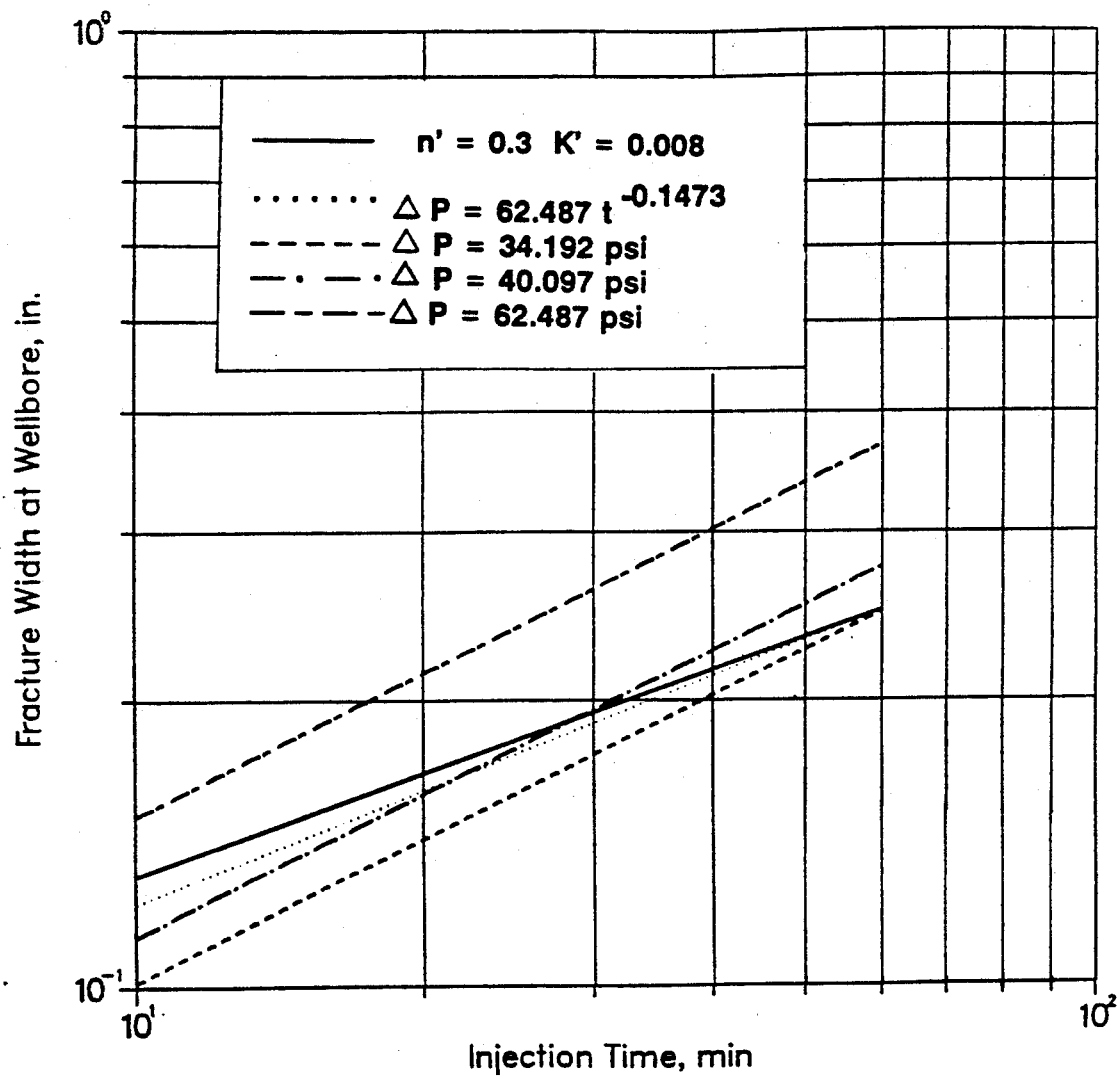
*Fig. 5—Width growth comparison: KZ geometry.*

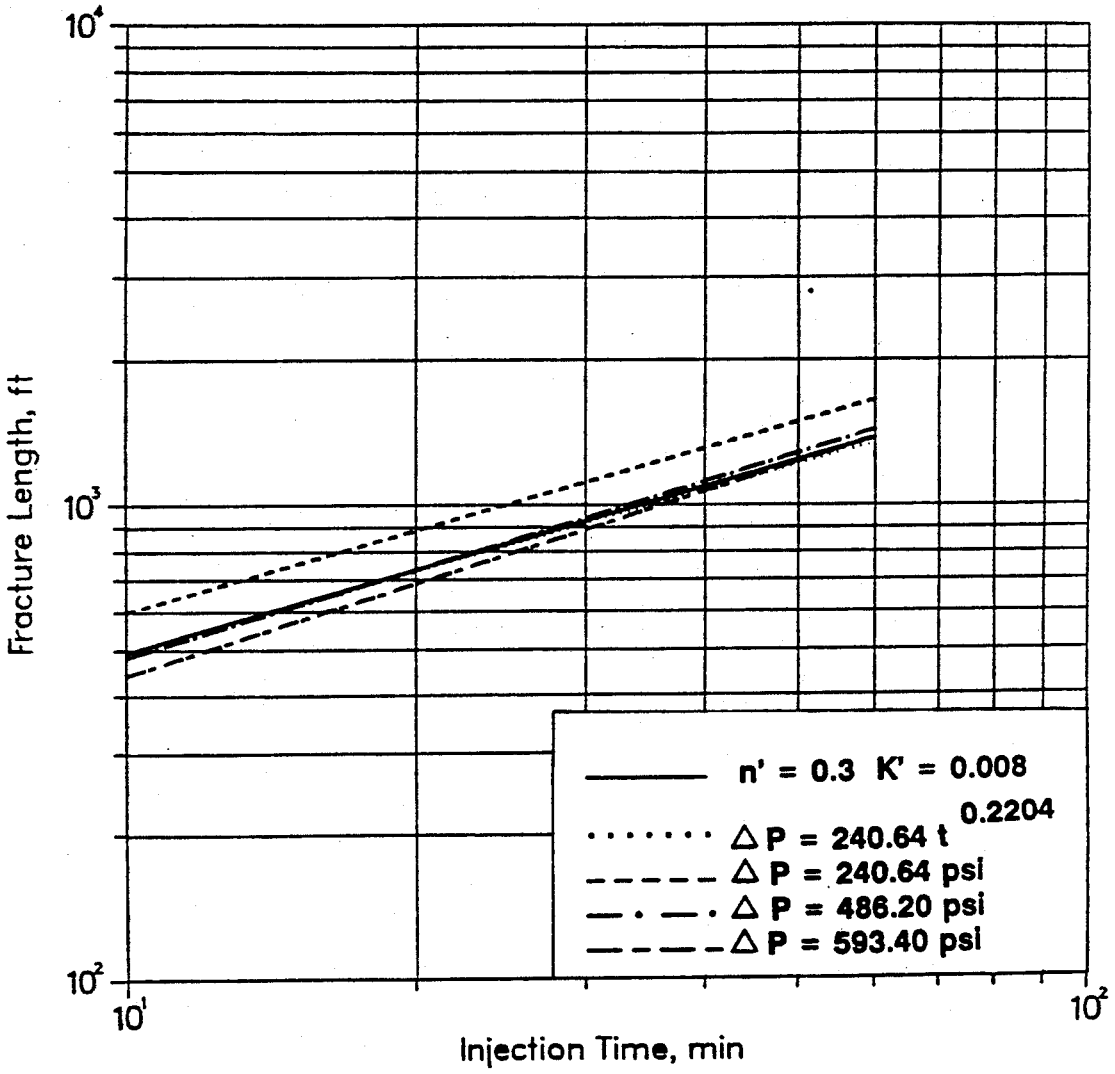
*Fig. 6—Length growth comparison: PK geometry.*

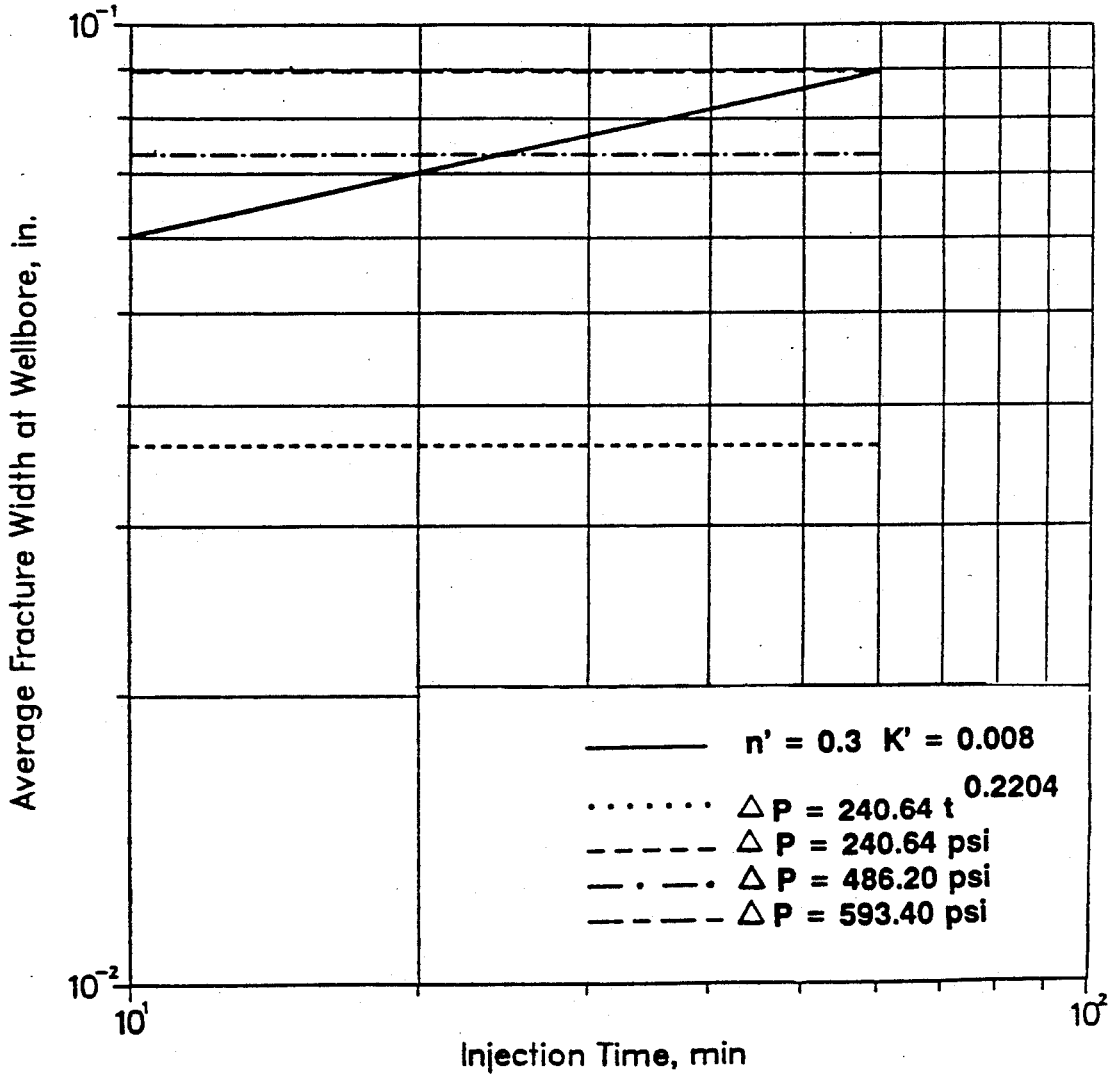
*Fig. 7—Width growth comparison: PK geometry.*

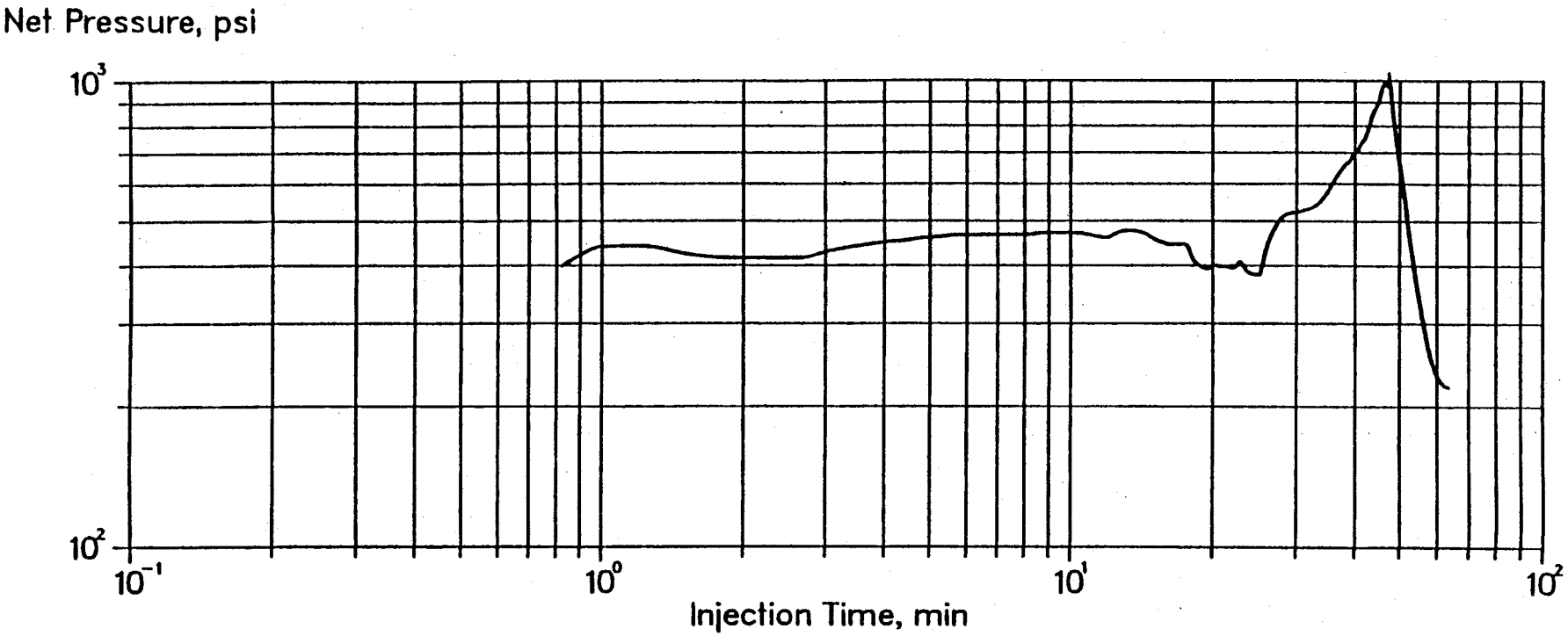
*Fig. 8—Net pressure profile: monitoring/analysis example.*

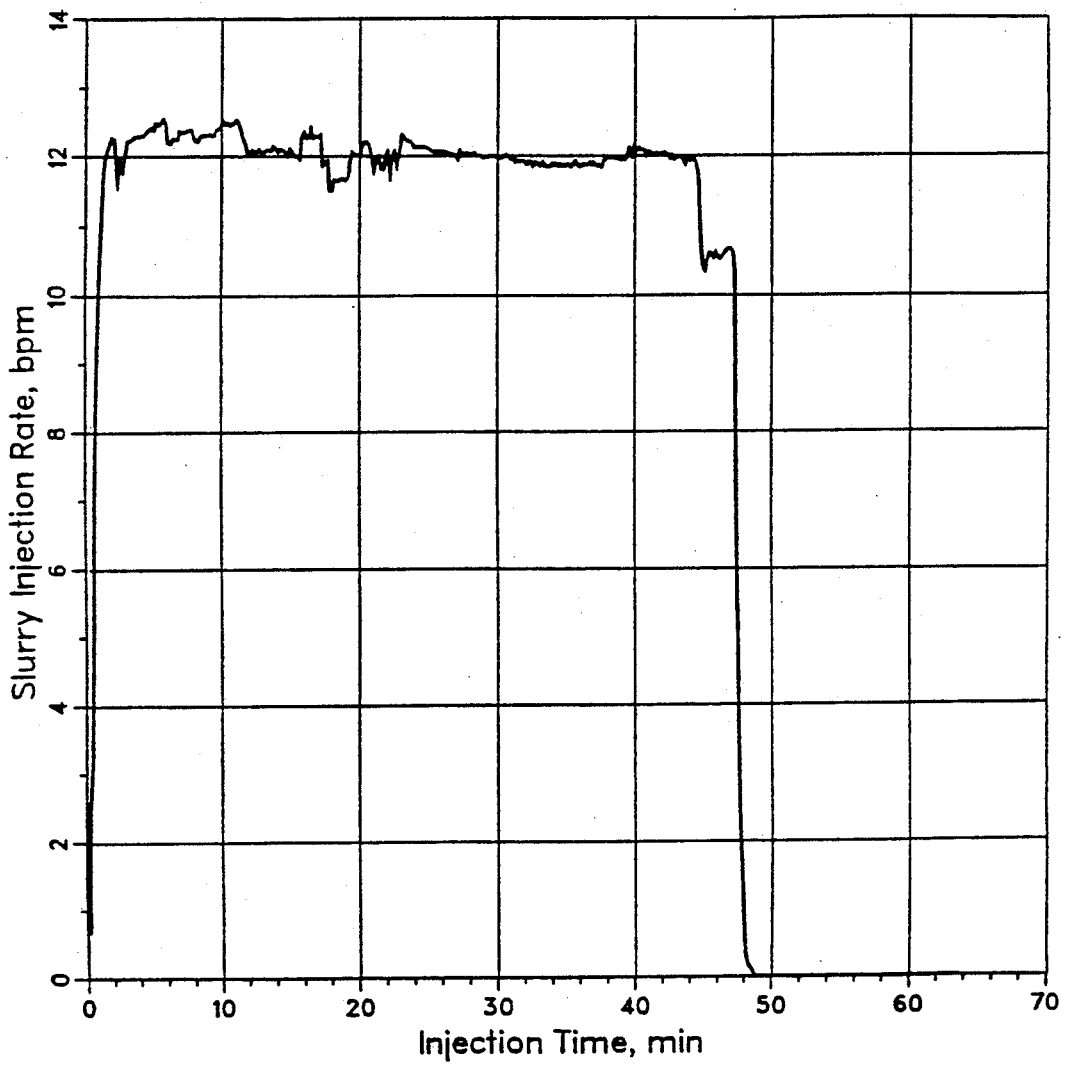
*Fig. 9—Injection rate: monitoring/analysis example.*

Fig. 10—Width growth behaviors: monitoring/analysis example.
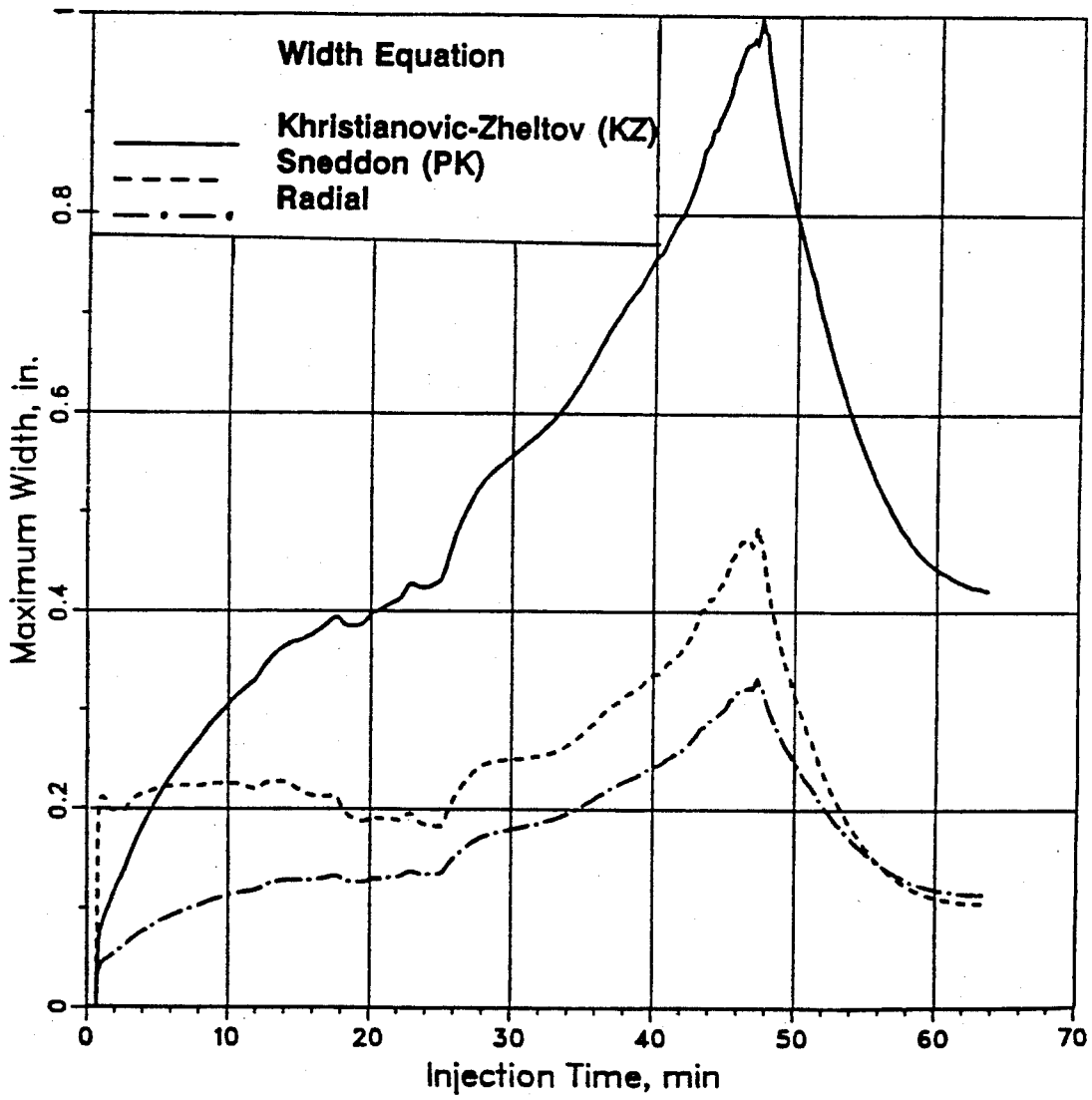

Fig. 11—Length growth behaviors: monitoring/analysis example.
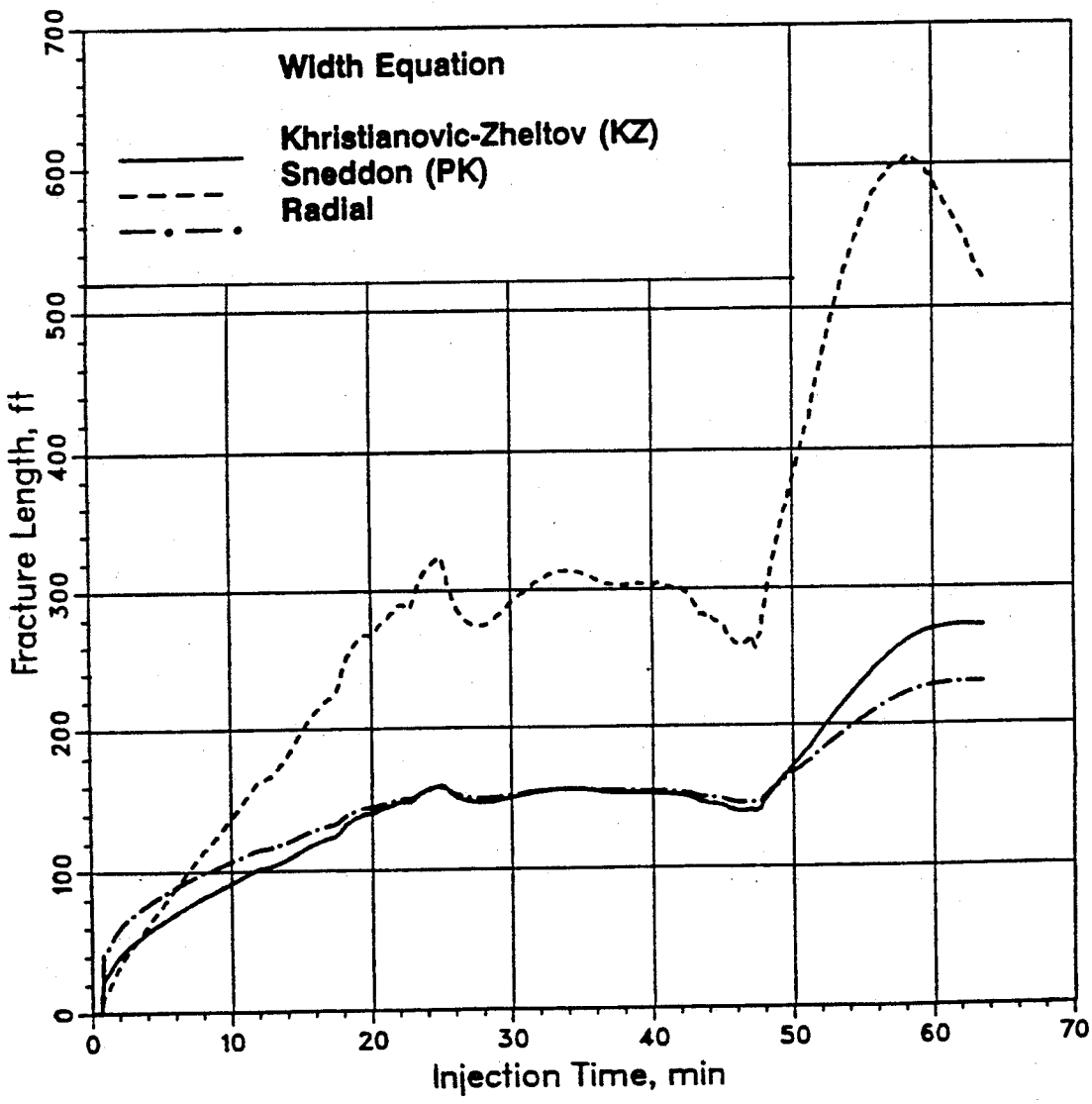

Fig. 12—Fluid efficiency behaviors: monitoring/analysis example.
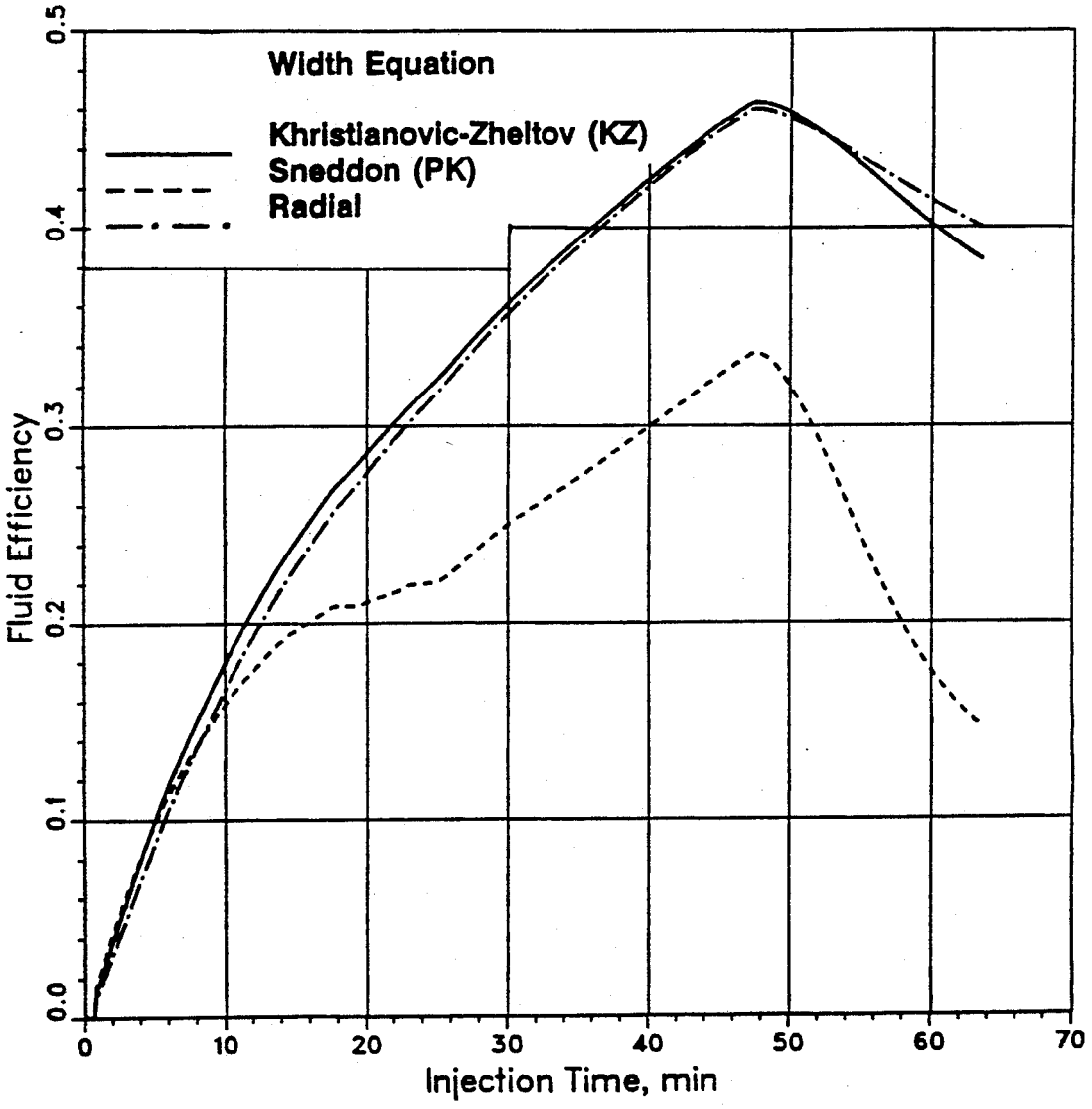

METHODS FOR DESIGN AND ANALYSIS OF SUBTERRANEAN FRACTURES USING NET PRESSURES

BACKGROUND OF THE INVENTION

Normal hydraulic fracturing treatment design calculations combine fracture mechanics, fluid mechanics, and a volume balance to predict fracture growth with time. Fracture mechanics relates fracture width to pressure and fracture length, height, or radius; fluid mechanics relates pressure to injection rate, width, and length or radius; and the volume balance relates the fracture volume to injection and fluid-loss rates.

Shlypaborsky, et al. in Society of Petroleum Engineers (SPE) Paper Nos. 18194 and 18195 noted that pressures obtained during fracturing treatments do not always agree with pressures predicted by fracture design models. Shlypaborsky listed five factors that have the potential for causing this disagreement: (1) high perforation friction pressure, (2) high friction pressure in the fracture, (3) the generation of multiple parallel fractures, (4) higher actual fracture toughness values than measured in the lab, and (5) a non-penetrating region near the fracture tip. To isolate the cause of the disagreement, Shlypaborsky et al. measured overpressure, which is the difference between downhole instantaneous shut-in pressure and the least principle stress, and thus eliminated the three friction-related effects from consideration. The overpressure, the result of one or both of the remaining two factors, was then used to determine an apparent fracture toughness. The apparent fracture toughness was subsequently used in a geometry model that considered fracture toughness in its solution to the fracture mechanics portion of the problem.

The methods of the present invention overcome many of the deficiencies in prior methods for determining fracture geometry. The new methods are further described in CIM/SPE paper 90–42 which is incorporated by reference.

To compensate for all four of the factors that may occur within the fracture and to provide more flexibility, methods in accordance with the present invention were developed that substitute net pressure for fluid mechanics determinations. The term "net pressure" as used herein refers to the difference between bottomhole treating pressure and least principle stress. By substituting (1) a given net (excess) pressure value, (2) a correlation between net pressure and time, or (3) a set of net pressure values for the net pressures determined through fluid mechanics relationships, methods that can determine fracture geometry for use in fracturing treatment design, monitoring, and analysis have been developed. The methods of the present invention allow calculations to be made for fracture design models which are well known to those skilled in the art, such as radial (penny-shaped) fracture geometry and geometries based on Khristianovic-Zheltov and Perkins and Kern width equations for constant height fractures. By considering the variation of injection rate and pressure with time, the method can also be used to calculate fracture behavior during shut-in and flowback as well as during injection.

The methods of the present invention also take into account situations such as multiple parallel fractures, faults, and natural fractures. In addition, by considering fluid mechanics, the limits set on the exponent relating pressure to time are expanded to radial models and models using the Khristianovic-Zheltov width equation as well as models using the Perkins and Kern width equation.

BRIEF DESCRIPTION OF THE DRAWINGS

FIG. 1 illustrates net pressure behavior for normal growth, arrested growth and proppant packing.

FIG. 2 illustrates net pressure behavior for arrested growth in one wing of the fracture.

FIG. 3 illustrates net pressure behavior in the presence of natural or secondary fractures.

FIG. 4 illustrates fracture length growth comparison for KZ geometry.

FIG. 5 illustrates fracture width growth comparison for KZ geometry.

FIG. 6 illustrates fracture length growth comparison for Perkins and Kern geometry.

FIG. 7 illustrates fracture width growth comparison for Perkins and Kern geometry.

FIG. 8 illustrates net fracturing pressure profile for the monitoring/analysis embodiment.

FIG. 9 illustrates injection rate for the monitoring/analysis embodiment.

FIG. 10 illustrates fracture width growth behaviors for the monitoring/analysis embodiment.

FIG. 11 illustrates fracture length growth behaviors for the monitoring/analysis embodiment.

FIG. 12 illustrates fluid efficiency behaviors for the monitoring/analysis embodiment.

SUMMARY OF THE INVENTION

A method for determining the geometry of a fracture in a subterranean formation is provided in which the geometry is determined using net fracture pressure. The method in accordance with the present invention takes into account net pressure throughout the fracturing job including periods when the treatment is shut-in or treatment fluid is flowed back until the fracture closes completely or until an obstruction is reached in the fracture. The present invention can be used for both fracture design purposes as well as on-site monitoring and post treatment analysis of fracture treatments. The method of the present invention generally comprises the steps of injecting fluid into the subterranean formation; monitoring the net fracturing pressure as a function of injection rate over time; determining the fracture volume from the fluid injection; calculating the fracture length using the net fracturing pressure behavior as a function of time; and determining fracture width.

DETAILED DESCRIPTION OF PREFERRED EMBODIMENT

The three basic fracture width equations—Khristianovic-Zheltov (KZ), Perkins and Kern (PK), and radial (penny-shaped)—relate fracture width to rock properties, net pressure, and a characteristic fracture dimension: length, height, or radius respectively. For the following description the letter "a" in equation numbers denotes KZ geometry, "b" denotes PK geometry, and "c" denotes radial geometry.

$$W_{max} = \frac{4(1-\nu^2)\Delta PL}{E} \qquad \text{EQN. 1(a)}$$

$$W_{max} = \frac{2(1-\nu^2)\Delta PH}{E} \qquad \text{EQN. 1(b)}$$

-continued $$W_{max} = \frac{8(1-\nu^2)\Delta PR}{\pi E} \quad \text{EQN. 1(c)}$$

where $W_{max}$=maximum fracture width at the wellbore $\nu$=poisson's ratio $\Delta P$ =net (excess) fracturing pressure L=fracture wing length H=fracture height R=fracture radius and E=Young's modulus.

Because (1) KZ models such as those of Daneshy and Geertsma and deKlerk approximate the fracture width profile as being elliptical with respect to horizontal distance from the wellbore and of constant width in the vertical direction, (2) Perkins and Kern's model assumes the fracture width profile is elliptical in the vertical direction and follows the relationship $$W(x) = W_{max}(1-x/L)^{\frac{1}{2}} \quad \text{EQN. 2}$$

in the length direction, where W=fracture width at a horizontal distance, x, from the well bore, and (3) the radial model is an ellipsoid of revolution, the average and maximum fracture widths are related by $$\overline{W} = \frac{\pi}{4} W_{max} \quad \text{EQN. 3(a)}$$

$$\overline{W} = \frac{\pi}{5} W_{max} \quad \text{EQN. 3(b)}$$

$$\overline{W} = \frac{2}{3} W_{max} \quad \text{EQN. 3(c)}$$

where $\overline{W}$=average fracture width.

Hence fracture volumes ($V_f$) can be calculated according to the following equations:

$$V_f = \frac{\pi}{2} HLW_{max} \quad \text{EQN. 4(a)}$$

$$V_f = 2\frac{\pi}{5} HLW_{max} \quad \text{EQN. 4(b)}$$

$$V_f = 2\frac{\pi}{3} R^2 W_{max} \quad \text{EQN. 4(c)}$$

Combining Eqns. 1 and 4 gives $$V_f = 2\pi \frac{(1-\nu^2)}{E} \Delta PHL^2 \quad \text{EQN. 5(a)}$$

$$V_f = \frac{4\pi}{5} \frac{(1-\nu^2)}{E} \Delta PH^2L \quad \text{EQN. 5(b)}$$

$$V_f = \frac{16}{3} \frac{(1-\nu^2)}{E} \Delta PR^3 \quad \text{EQN. 5(c)}$$

A volume balance shows that the fracture volume equals the volume of injected fluid ($V_i$) less the fluid volume that is lost to the formation by leak-off ($V_{fl}$).

$$V_f = V_i - V_{fl} = \int_0^t Q(t)dt - V_{fl} \quad \text{EQN. 6}$$

The integral (volume injected) term simplifies to Qt for injection at a constant rate.

The volume of fluid lost to the formation can be calculated according to $$V_{fl}(L) = 4h \int_0^L \int_0^t V_{fl}(x,t)dtdx \quad \text{EQN. 7(a,b)}$$

$$V_{fl}(R) = 2 \int_0^R \frac{A_{fl}(r)}{r} \int_0^t V_{fl}(r,t)dtdr \quad \text{EQN. 7(c)}$$

where t=injection time x=horizontal distance from the wellbore $A_{fl}$=fluid loss area of fracture r=radial distance from the center of the fracture and where the apparent fluid-loss velocity, $v_{fl}$, can be determined using available correlations.

Combining Eqns. 5 and 6 yields $$2\pi \frac{(1-\nu^2)}{E} \Delta PHL^2 = \int_0^t Q(t)dt - V_{fl}(L) \quad \text{EQN. 8(a)}$$

$$4\frac{\pi}{5} \frac{(1-\nu^2)}{E} \Delta PH^2L = \int_0^t Q(t)dt - V_{fl}(L) \quad \text{EQN. 8(b)}$$

$$\frac{16}{3} \frac{(1-\nu^2)}{E} \Delta PR^3 = \int_0^t Q(t)dt - V_{fl}(R) \quad \text{EQN. 8(c)}$$

which may be combined with Eqn. 7 and solved numerically for L or R. Once the length or radius is know, Eqn. 1(a) or 1(c) may be used to determine fracture width for KZ or radial geometry. Equation 1(b) for PK geometry does not require length to be known before width can be calculated.

To allow fracture length (radius) and width and fluid efficiency to be determined using net fracturing pressures, a general method for solving Eqn. 8 has been devised and implemented. The method can be used for fracture treatment design and for on-site monitoring and post treatment analysis of a fracture treatment. The methods can be carried out by use of an appropriately programmed computer.

The methods of the present invention are generally performed by the following steps. First, the volume of slurry injected during the current time step is determined from the duration of the time step and the current injection rate. This volume is added to the previously injected volume to get the total volume injected into the formation. The cumulative volume of fluid lost to the formation up through the previous time step is next determined. The maximum possible fracture volume is found by subtracting the previously lost volume from the total injected volume. Using the maximum possible fracture volume and Eqn. 5, an upper bound on the fracture length or radius is calculated. This will also serve as an initial estimate on the fracture length or radius.

Using the current estimate of fracture length (radius), the corresponding volume of fluid lost during the current time step is determined. This volume is subtracted from the maximum possible fracture volume to obtain the current fracture volume. Using this volume and Eqn. 8, a new fracture length (radius) is calculated. If the estimated and calculated lengths (radii) do not agree within an acceptable tolerance, the estimated length (radius) is refined and this process is repeated until convergence is achieved. An acceptable tolerance is agreement between the estimated and calculated length (radius) of about 5% or less. The preferred range is about 1.0% to about 0.1% and the most preferred tolerance is about 0.1%. Once the acceptable tolerance is achieved, fracture width is calculated from Eqn. 1.

In one embodiment, logarithmic least squares fits are performed on length (radius) vs. time and width vs. time data (i.e., fit the data to power-law type equations) to provide a means for rapidly determining fracture length (radius) and width in subsequent calculations. In this embodiment it is assumed that the injection rate is constant and does not allow fracture length to decrease. The net pressure is assumed to follow power-law type behavior and thus, the user must supply the expected net pressure value at 1 minute and an $\epsilon$ value within the limits set by Eqn. 11 where the time exponent, $\epsilon$, is a power by which net pressure is related to time. If calculations for a constant net pressure value are desired, $\epsilon$ would be set to 0 by the user.

A second embodiment for monitoring and analyzing a fracture treatment allows net pressure and injection rate to vary with time. The net pressure is, of course, limited to positive values but the injection rate can be zero (for shut-in) or negative (for flowback) as well as positive. Fracture length and width are allowed to decrease with time. If in the monitoring/analysis embodiment a decrease in fracture length is calculated, fluid previously lost through reabsorbed fracture area remains lost and the previously built-up resistance to leak-off in that region will be considered should the fracture regrow to cover that area again.

It is possible to learn a fair amount about the expected behavior of the net pressure methods by making certain simplifying assumptions and determining the rates of pressure increase or decrease for which the various models will predict that fracture growth will occur.

If fluid loss is negligible ($V_{fl}=O$) and the injected fluid is incompressible, the rate the fracture increases in volume will equal the injection rate. In addition, if the injection rate is constant, the rate of volume increase will be proportional to time and thus the product of length and width will be proportional to time for the KZ and PK models and the product of width and the square of the radius will be proportional to time for the radial model.

$$L\,W_{max} \propto t \qquad \text{EQN. 9(a,b)}$$

$$R^2\,W_{max} \propto t \qquad \text{EQN. 9(c)}$$

This can be substantiated by combining Eqns. 4 and 6.

Stated in other terms, if width is constant, length will be proportional to time for the constant height geometry models. Likewise, if length is constant, width will be proportional to time. For the radial model, radius will be proportional to the square root of time if width is constant and width will be proportional to time if radius is constant.

Therefore, to determine the pressure conditions under which the models will predict both width and length or radius to grow (at constant injection rate), either Eqn. 1, or Eqn. 8 as simplified by the assumptions of constant rate and negligible fluid loss, may be solved for $\Delta P$.

$$\Delta P = \frac{E}{4(1-\nu^2)}\,\frac{W_{max}}{L} \qquad \text{EQN. 10(a)}$$

-continued $$\Delta P = \frac{E}{2(1-\nu^2)}\,\frac{W_{max}}{H} \qquad \text{EQN. 10(b)}$$

$$\Delta P = \frac{\pi E}{8(1-\nu^2)}\,\frac{W_{max}}{R} \qquad \text{EQN. 10(c)}$$

For KZ geometry, if width is constant and length is proportional to time, $\Delta P$ will be inversely proportional to time; if length is constant and width proportional to time, $\Delta P$ will be directly proportional to time.

For PK geometry, a constant width with length proportional to time will give a constant $\Delta P$; a constant length with width proportional to time will result in $\Delta P$ being proportional to time.

For radial geometry, holding width constant and increasing radius proportionally to the square root of time results in $\Delta P$ varying in inverse proportion to the square root of time; holding radius constant and increasing width proportionally to time results in $\Delta P$ increasing proportionally to time.

Thus, for both fracture length and width to be predicted to grow under the assumptions made, the time exponent by which the pressure changes, $\epsilon$, will need to fall between the following limits:

$$-1<\epsilon<1 \qquad \text{EQN. 11(a)}$$

$$0<\epsilon<1 \qquad \text{EQN. 11(b)}$$

$$-\tfrac{1}{2}<\epsilon<1 \qquad \text{EQN. 11(c)}$$

These time exponents, $\epsilon$, may be equivalently looked upon as slopes on a log net pressure vs. log time graph. The limits will vary slightly from the tabulated values when fluid loss is considered, with the variance increasing as fluid efficiency decreases. For negligible fluid loss, a time exponent or log-log slope less than the lower limit implies the fracture is narrowing and an exponent or slope greater than the upper limit implies the fracture is shortening.

From Eqn. 11 and the above discussion, a unit slope of log($\Delta P$) vs. log(t) (FIG. 1) indicates arrested horizontal (length) growth of both fracture wings; however, contrary to prior analysis methods, a slope greater than 1 indicates that the fracture is shortening with the width increasing at a more dramatic rate, (assuming, of course, that the fracture continues to meet the assumptions under which the relationships were developed). The shortening would most likely be an "effective" shortening of the fracture due to proppant packing off the fracture increasingly nearer to the wellbore.

Additionally, if one wing is completely blocked and the second is merely restricted, the log-log slope will be the same as if both were accepting fluid but were restricted; the curve will merely be shifted vertically by a factor of $2^{n'}$ as can be shown from Eqn. 12:

$$\frac{W}{2}\,\frac{dP}{dx} = K'\left[\frac{6q}{W^2h}\right]^{n'} \qquad \text{EQN. 12(a,b)}$$

$$\frac{W}{2}\,\frac{dP}{dr} = K'\left[\frac{6q}{\pi W^2 r}\right]^{n'} \qquad \text{EQN. 12(c)}$$

where q=flow rate

K'=power law consistency index for slot (fracture flow)

W=fracture width n'=power law behavior index p=pressure.

The situation would be analogous to injecting at twice the rate into two restricted wings and the slope on a Cartesian coordinate graph, not the log-log graph, would be increased by this factor. Similarly, if growth of one wing is restricted and the other wing is growing without horizontal restriction, such as could occur if the fracture encountered an impenetrable fault, the log-log slope will be similar to that for unrestricted growth of both wings but the curve will be shifted upward, as is illustrated by FIG. 2.

In general, it can be shown from Eqn. 12 that $$\Delta p \propto Q^{n'} \qquad \text{EQN. 13}$$

and thus any change in the effective flow rate into a fracture wing will cause a corresponding vertical shift on the log (ΔP) vs. log(t) curve. An additional consequence of this observation is that the initiation of secondary parallel fractures should result in a downward shift of the curve. However, because the additional fractures will be parallel and in close proximity to the primary fracture, the effects of the rock properties (E and $\nu$) would need to be considered in quantifying the effective fracture wings from the degree of shift.

As stated before, slopes less than the lower limits listed above indicate that the fracture is narrowing. Under conditions of constant injection rate and constant fluid properties, this could be indicative of less restricted height growth resulting from penetration into a zone with lower least principal stress. It could also indicate fracture penetration, vertically or horizontally, into an area of higher fluid-loss rate.

We can also infer that encountering a natural fracture that accepts fluid will result in the slope temporarily decreasing and eventually regaining its pre-encounter value (FIG. 3). The rapidity of the shift will give some indication of the behavior of the natural fracture. A sudden shift, for example, would indicate that the natural fracture was open or easily opened and accepted fluid readily. A gradual shift would indicate a slower rate of fluid loss into the natural fracture. If the natural fractures are closely enough spaced, individual encounters may become indistinguishable on the graph, the result being simply a continued lower slope.

Methods described herein based strictly on fracture mechanics considerations and a volume balance, show pressure behaviors that indicate whether or not the fracture width or the fracture length is growing. Prior art methods have considered the fluid mechanics aspects of the problem to determine the expected behavior under ideal growth conditions. However, the prior art methods generally limited their consideration to PK-type models or provided no theoretical and little, if any, empirical justification for the reported pressure behavior for KZ and radial models.

The expected pressure responses for KZ, PK, and radial fractures under conditions of constant injection of an incompressible fluid with little or no fluid loss are $$\Delta P \propto t^{-n'/((n'+2)} \qquad \text{EQN. 14(a)}$$

$$\Delta P \propto T^{1/(2n'+3)} \qquad \text{EQN. 14(b)}$$

$$\Delta P \propto t^{-n'/(n'+2)} \qquad \text{EQN. 14(c)}$$

Prior art methods can be extended to also give a bounding value of the time exponent, $\epsilon$, for the case of high fluid loss with PK-type models. Using analogous methods, it is possible to derive high fluid loss $\epsilon$ values for KZ and radial geometries.

$$\Delta P \propto t^{-n'/2(n'+1)} \qquad \text{EQN. 15(a)}$$

$$\Delta P \propto t^{\frac{1}{4}(n'+1)} \qquad \text{EQN. 15(b)}$$

$$\Delta P \propto t^{-3n/8(n'+1)} \qquad \text{EQN. 15(c)}$$

All three of these equations were derived under the assumption that, under conditions of high fluid loss, L is proportional to the square root of time and R is proportional to the fourth root of time, as can be demonstrated to be the case for PK geometry from Carter's work and as was demonstrated to be the case for KZ and radial geometry by Geertsma and deKlerk.

From Eqns. 14 and 15, the expected ranges of e values can be determined for any given n' value. For an n' of 1, the $\epsilon$ ranges for different geometries are $$-\tfrac{1}{3} \leqq \epsilon \leqq -\tfrac{1}{4} \qquad \text{EQN. 16(a)}$$

$$\tfrac{1}{8} \leqq \epsilon \leqq 1/5 \qquad \text{EQN. 16(b)}$$

$$-3/16 \leqq \epsilon \leqq -\tfrac{1}{8} \qquad \text{EQN. 16(c)}$$

For n' equal to its lower, although unattainable, bound of 0, the $\epsilon$ ranges are $$\epsilon = 0 \qquad \text{EQN. 17(a)}$$

$$\tfrac{1}{4} \leqq \epsilon \leqq \tfrac{1}{3} \qquad \text{EQN. 17(b)}$$

$$\epsilon = 0 \qquad \text{EQN. 17(c)}$$

Therefore, PK geometries should show small positive slopes on log-log plots; KZ and radial geometries should show small negative slopes. In fact, the similarity of $\epsilon$ ranges should make it difficult to distinguish KZ from radial growth behavior from the slope of the pressure curve alone. It is also interesting to note from Eqn. 14 at least theoretically, if not practically, a hydraulic fracture could be used as a viscometer if the conditions under which the relationships were derived were strictly met.

EXAMPLES

The following examples are provided to illustrate the methods of the present invention but are not intended in any way to limit the invention.

Example 1

To ideally design a fracturing treatment using net pressures, pressure data from a similar treatment in an offset well in the same formation should be used. If, however, data are available from an offset well, but the treatment rate or fluid to be used is different, the design version of the net pressure model can still be employed by using the observed log-log slope ($\epsilon$), but adjusting the 1 minute pressure value according to $$\Delta P_{1\ min,\ new} = \Delta P_{1\ min,\ old} \frac{(K'Q^{n'})_{new}}{(K'Q^{n'})_{old}} \qquad \text{EQN. 18}$$

Comparative examples were run to demonstrate the net pressure method of the present invention.

Fracture geometry and net pressure responses were calculated using the models of Daneshy and Perkins and Kern employing the formation and fluid data listed in Table 1 and a job time of 60 minutes. The fracture geometries for the corresponding width equations (KZ and PK) were then recalculated using the design version of the net pressure model. This was done for four different assumed pressure responses: (1) the predicted net pressure response (i.e., $\Delta P$ at 1 minute and $\epsilon$), (2) the predicted I minute net pressure value, (3) the average net pressure over the 60 minute period, and (4) the predicted 60 minute net pressure value. Table 2 and FIGS. 4 and 5 present the results for Daneshy's model and for the net pressure method with the KZ width equation. Table 3 and FIGS. 6 and 7 present the results for Perkins and Kern's model and for the net pressure method with the PK width equation.

TABLE 1

| Treatment Parameters Design Example |
|---|
| Injection rate = 10 bbl/min |
| $n' = 0.3$ |
| $K' = 0.008\ lb_f sec^{n'}/ft^2$ |
| Fracture height = 50 ft |
| Permeable height within fracture = 20 ft |
| Young's modulus = $6 \times 10^6$ psi |

TABLE 1-continued

| Treatment Parameters Design Example |
|---|
| Poisson's ratio = 0.2 |
| $C_{eff} = 0.002\ ft/min^{\frac{1}{2}}$ |

TABLE 2

| Fracture Growth as Predicted by Net Pressure Model (KZ Geometry) | | | | | |
|---|---|---|---|---|---|
| | Fracture Length | | Width at Wellbore | | Fluid |
| Assumed Net Pressure Behavior | @ 1 min (ft) | Growth Exponent | @ 1 min (in.) | Growth Exponent | Efficiency @ 60 min |
| Daneshy model | 118.5 | 0.508 | 0.0569 | 0.361 | 0.458 |
| $\Delta P = 62.487\ t^{-0.1473}$ psi | 101.3 | 0.546 | 0.0486 | 0.399 | 0.461 |
| $\Delta P = 34.192$ psi | 121.6 | 0.501 | 0.0319 | 0.501 | 0.455 |
| $\Delta P = 40.097$ psi | 115.5 | 0.501 | 0.0356 | 0.501 | 0.482 |
| $\Delta P = 62.487$ psi | 99.3 | 0.501 | 0.0477 | 0.501 | 0.555 |

TABLE 3

| Fracture Growth as Predicted by Net Pressure Model (PK Geometry) | | | | | |
|---|---|---|---|---|---|
| | Fracture Length | | Average Width at Wellbore | | Fluid |
| Assumed Net Pressure Behavior | @ 1 min (ft) | Growth Exponent | @ 1 min (in.) | Growth Exponent | Efficiency @ 60 min |
| Perkins & Kern model | 131.7 | 0.573 | 0.0363 | 0.220 | 0.244 |
| $\Delta P = 240.64\ t^{0.2204}$ psi | 137.4 | 0.558 | 0.0363 | 0.220 | 0.239 |
| $\Delta P = 240.64$ psi | 176.9 | 0.532 | 0.0363 | 0.000 | 0.112 |
| $\Delta P = 486.20$ psi | 118.4 | 0.610 | 0.0733 | 0.000 | 0.208 |
| $\Delta P = 593.40$ psi | 102.2 | 0.637 | 0.0895 | 0.000 | 0.245 |

From FIG. 4, we can see that in this instance the length curve for $\Delta P = 34.192$ psi nearly coincides with the length curve calculated from Daneshy's model. However, by comparing the width curves on FIG. 5, we find that they disagree at early times. Instead, the curves generated using the net pressure behavior predicted by Daneshy's model agree more closely with that model, as they should. Likewise, as can be seen on FIGS. 6 and 7 and on Table 3, using the pressure behavior predicted by Perkins and Kern's model in the net pressure method produces results virtually identical to those of the original model.

As would be expected, with either width equation the net pressure method of the present invention predicts a greater width and a shorter length when a higher constant pressure is entered. A more significant aspect of this is that in both cases when a constant pressure is assumed, the final length and width agree more closely with those predicted by the traditional models when the final net pressure is used. From this we can conclude that the most important aspect of using the net pressure methods is matching the final pressure of the job and secondary in importance is matching the preceding pressure history.

From Eqn. 9, derived for circumstances of negligible fluid loss, and Eqn. 10, it is easily shown that the following proportionalities should hold under the same conditions:

$$W_{max} \propto t^{(1+\epsilon)/2} \qquad \text{EQN. 19(a)}$$

$$W_{max} \propto t^{\epsilon} \qquad \text{EQN. 19(b)}$$

$$W_{max} \propto t^{(1+2\epsilon)/3} \quad \text{EQN. 19(c)}$$

$$L \propto t^{(1-\epsilon))/2} \quad \text{EQN. 20(a)}$$

$$L \propto t^{1-\epsilon} \quad \text{EQN. 20(b)}$$

$$R \propto t^{(1-\epsilon)/3} \quad \text{EQN. 20(c)}$$

By assuming $L \propto t^{\frac{1}{2}}$ *or* $R \propto t^{\frac{1}{3}}$, *and using Eqn.* 10, the following proportionalities for fracture width can be derived for high fluid-loss conditions:

$$W_{max} \propto t^{(1+2\epsilon)/2} \quad \text{EQN. 21(a)}$$

$$W_{max} \propto t^{\epsilon} \quad \text{EQN. 21(b)}$$

$$W_{max} \propto t^{(1+4\epsilon)/4} \quad \text{EQN. 21(c)}$$

By inserting the proper $\epsilon$ values into these relationships and by considering the actual fluid efficiencies, we can see that all calculated length and width growth exponents reported in Tables 2 and 3 have values extremely close to those expected. In other words, behavior approaches that predicted by Eqns. 19 and 20 at high efficiencies and approaches that predicted by Eqn. 21 at low efficiencies.

Example 2

A net pressure method in accordance with the present invention was executed using pressure and rate data from a fracturing treatment performed in the San Andres formation of west Texas. The planned treatment comprised a pad stage of 11,000 gal, a 10,000 gal stage containing 20/40 mesh sand ramped from 0.5 to 6 lb/gal, a 3,000 gal stage containing 6 lb 20/40 mesh sand/gal, and a flush stage. (Additional treatment data are listed in Table 4.). Because of rapidly increasing treating pressures, as shown on the log(ΔP)−log(t) graph of FIG. 8, the 6 lb/gal stage was not pumped.

TABLE 4

| Treatment Parameters Monitoring/Analysis Example |
|---|
| $n' = 0.568$ |
| $K' = 0.0765$ lb/sec$^{n'}$/ft$^2$ |
| Fracture height (KZ and PK geometries) = 135 ft |
| Permeable height = 63 ft |
| Young's modulus = $6.5 \times 10^6$ psi |
| Poisson's ratio = 0.2 |
| $C_{eff} = 0.00153$ ft/min$^{\frac{1}{2}}$ |

For the first 18 minutes of the pad stage, the net pressure,

For the first I measured through a live annulus, exhibited no particularly unusual behavior. At around 18 minutes into the treatment, the net pressure experienced a rapid I3% decline. The simultaneous drop in injection rate (FIG. 9) of approximately 5%, which from Eqn. 13 should have resulted in a net pressure change of 3%, is insufficient to account for the actual drop in pressure. Because the San Andres formation is naturally fractured, a likely explanation is that the hydraulic fracture encountered or opened a natural fracture at this point.

FIG. 10, a graph of fracture width as calculated by the net pressure model for each of the three width equations, shows a corresponding decrease in fracture width when pressure drops. It is interesting to note that for the initial 18 minutes of the treatment, when the rate and pressure are reasonably stable, the model predicts gradually increasing widths with the KZ and radial geometries, but a quickly acquired and fairly constant width for the PK geometry.

The length growth for all three geometries is gradual during this period (FIG. 11). At the point where the pressure drops, the rate of growth increases because the model cannot account for the additional fluid loss from the unexpected heterogeneity, instead treating the natural fracture as additional fracture length.

Shortly after the proppant enters the perforations at 24.5 minutes, the net pressure starts rising rapidly, with a slope much steeper than 1 on the log-log graph. At the same time, the calculated width increases rapidly and the length decreases. The rises in pressure and width, and the decrease in effective length can be attributed to proppant screenout in the fracture and provide further evidence of unanticipated fluid loss to natural fractures.

At about 28 minutes into the treatment, the log-log slope temporarily decreases to a normal value, as does the rate of width growth. The calculated length is shown to increase, but since the preceding screenout behavior should preclude this from happening, a plausible conclusion would be that the prior increase in pressure has opened a previously encountered natural fracture, or possibly, but less likely, a secondary fracture The calculated increase in length can be viewed either as the inability of the model to consider the heterogeneity or as an increase in effective length. Shortly thereafter, pressure and width restart their rapid rises and, because of proppant packing, the effective length decreases.

When injection ceases following the flush (injected at approximately 10.5 bpm), the pressure, of course, declines The great increase in calculated length results from the model's current inability to consider the effect of the proppant that is packed inside the fracture If the fracture width were held constant or nearly so, the calculated length would decrease as a result of fluid loss. When a treatment proceeds normally, i.e., without screenout and the accompanying extreme rise in pressure, the pressure fall-off at shut-in will be less severe and the lesser calculated fracture length growth during this same period can be assumed to be realistic at least until proppant or other physical obstructions limit the fracture width from further decreasing.

FIG. 12 illustrates the calculated fluid efficiencies for the three geometries for the Example 2.

What is claimed:

1. A method for determining the geometry of a fracture created in a subterranean formation comprising the steps of:

(a) injecting fluid into said subterranean formation;

(b) monitoring the net fracturing pressure as a function of the fluid injection rate over time;

(c) determining the fluid volume injected for a fixed time period from the injection rate of fluid;

(d) adding the volume determined from step (c) to the volume of fluid injected into said subterranean formation prior to said fixed time period;

(e) determining the volume of fluid lost into said subterranean formation from previously created fracture area;

(f) calculating an upper bound on fracture length according to the equations:

$$2\pi \frac{(1-\nu^2)}{E} \Delta PHL^2 = \int_0^t Q(t)dt - V_{fl}(L)$$

$$4\frac{\pi}{5} \frac{(1-\nu^2)}{E} \Delta PH^2L = \int_0^t Q(t)dt - V_{fl}(L)$$

$$\frac{16}{3} \frac{(1-\nu^2)}{E} \Delta PR^3 = \int_0^t Q(t)dt - V_{fl}(R)$$

(g) estimating a first fracture length based upon previous bounds of fracture length;

(h) determining volume of fluid loss using said first fracture length;

(i) calculating a second fracture length according to step (f);

(j) comparing the first fracture length determined in step (g) to the second fracture length determined in step (i) to determine whether the difference between the two is within acceptable tolerance;

(k) repeating steps (g) through (i) until an acceptable tolerance is achieved;

(l) determining fracture width; and (m) using said net fracturing pressure behavior to design a fracture treatment.

2. The method according to claim 1 where in steps (c) through (l) are repeated until calculations have been made for all the desired incremental time steps.

3. A method for determining the geometry of a fracture created in a subterranean formation comprising the steps of:

(a) estimating the net fracturing pressure as a function of the fluid injection rate over time;

(b) determining the fluid volume injected for a fixed time period from the injection rate of fluid;

(c) adding the volume determined from step (b) to the volume of fluid injected into said subterranean formation from previously created fracture area;

(e) calculating an upper bound on fracture length according to the equations:

$$2\pi \frac{(1-\nu^2)}{E} \Delta PHL^2 = \int_0^t Q(t)dt - V_{fl}(L)$$

$$4\frac{\pi}{5} \frac{(1-\nu^2)}{E} \Delta PH^2L = \int_0^t Q(t)dt - V_{fl}(L)$$

$$\frac{16}{3} \frac{(1-\nu^2)}{E} \Delta PR^3 = \int_0^t Q(t)dt - V_{fl}(R);$$

(f) estimating a first fracture length based upon previous bounds of fracture length;

(g) determining volume of fluid loss using said first fracture length;

(h) calculating a second fracture length according to step (f);

(i) comparing the first fracture length determined in step (f) to the second fracture length determined in step (h) to determined whether the difference between the two is within acceptable tolerance;

(j) repeating steps (f) through (i) until acceptable tolerance is achieved;

(k) determining fracture width;

(l) performing logarithmic least squares fit on said fracture lengths versus time and said fracture widths versus time to provide a means for rapidly determining said fracture length and fracture width in subsequent steps; and (m) using said net fracturing pressure behavior to design a fracture treatment.

* * * * *

UNITED STATES PATENT AND TRADEMARK OFFICE

CERTIFICATE OF CORRECTION

PATENT NO. : 5,070,457
DATED : December 3, 1991
INVENTOR(S) : Don K. Poulsen

It is certified that error appears in the above-identified patent and that said Letters Patent is hereby corrected as shown below:

In column 3, line 21, EQN. 2, change "1/2" to --1/4--.

In column 3, line 29, EQN. 3(a), change "W" to --$\bar{W}$-- as in line 37.

In column 3, line 31, EQN. 3(b), change "W" to --$\bar{W}$-- as in line 37.

In column 3, line 34, EQN. 3(c), change "W" to --$\bar{W}$-- as in line 37.

In column 7, line 20, change "Δp" to --ΔP--.

In column 7, line 67, delete first "(".

In column 8, line 28, change "e" to --ε--.

In column 8, line 34, change "$\overset{<}{=}$" to --≤--.

In column 8, line 36, change "$\overset{<}{=}$" to --≤--.

In column 8, line 39, change "$\overset{<}{=}$" to --≤--.

In column 8, line 48, change "$\overset{<}{=}$" to --≤--.

In column 9, line 52, change "I" to --1--.

UNITED STATES PATENT AND TRADEMARK OFFICE

CERTIFICATE OF CORRECTION

PATENT NO. : 5,070,457

DATED : December 3, 1991

INVENTOR(S) : Don K. Poulsen

It is certified that error appears in the above-identified patent and that said Letters Patent is hereby corrected as shown below:

In column 11, line 11, change type size from "$L \propto t^{1/2}$ or $R \propto t^{1/4}$, and using Eqn." to --$L \propto t^{1/2}$ or $R \propto t^{1/4}$, and using Eqn.--.

In column 11, line 57, delete the words "For the first I".

In column 12, line 33, change "effective" to --<u>effective</u>--.

In column 12, line 41, change "fracture If" to --fracture. If--.

In claim 3 at column 14, line 5, insert after "formation" and before "from" --prior to said fixed time period; (d) determining the volume of fluid lost into said subterranean formation--.

Signed and Sealed this

Thirtieth Day of March, 1993

*Attest:*

STEPHEN G. KUNIN

*Attesting Officer*

*Acting Commissioner of Patents and Trademarks*